United States Patent [19]

Barber

[11] 4,201,384

[45] May 6, 1980

[54] SET OF GOLF BALLS

[76] Inventor: Jerry Barber, P.O. Box 550, La Canada, Calif. 91011

[21] Appl. No.: 800,564

[22] Filed: May 25, 1977

[51] Int. Cl.[2] ..... A63B 69/36

[52] U.S. Cl. ..... 273/199 R; 273/DIG. 20; 35/29 A

[58] Field of Search ..... 35/29 A, 56; 273/199 R, 273/199 A, 34 B, 62, 178 R, 35 R, 35 B, DIG. 20, 232, 219

[56] References Cited

U.S. PATENT DOCUMENTS

| | | | |
|---|---|---|---|
| 1,653,893 | 12/1927 | Eden | 273/199 R X |
| 2,364,955 | 12/1944 | Diddel | 273/199 R |
| 3,638,334 | 2/1972 | Malikowski | 35/56 X |
| 4,026,561 | 5/1977 | Baldorossi et al. | 273/199 R X |

FOREIGN PATENT DOCUMENTS

| | | | |
|---|---|---|---|
| 220377 | 8/1924 | United Kingdom | 273/178 R |

OTHER PUBLICATIONS

"The Curious History of the Golf Ball, Mankinds Most Fascinating Sphere," by John Stuart Martin, Horizon Press, New York, 1968, pp. 88–93 relied on.

*Primary Examiner*—George J. Marlo
*Attorney, Agent, or Firm*—Christie, Parker & Hale

[57] ABSTRACT

A method of teaching golf utilizing a progression of golf balls of diminishing size. In one aspect, the method provides for starting with an oversize ball and using several increasingly smaller balls as the playing ability of the student improves until a conventional size ball is used. The method also contemplates the use of golf clubs with oversize heads. The present method contemplates a one-step reduction in the size of the golf club head from oversize to conventional size.

6 Claims, 5 Drawing Figures

SET OF GOLF BALLS

DESCRIPTION OF THE PRIOR ART

The present invention relates to the teaching and learning of the game of golf and in particular a method of teaching how to play golf which gradually prepares the learning player to play with conventional size golf balls and conventional size golf clubs by starting with balls and clubheads which are significantly larger than conventional size.

In the conventional approach to the teaching of the game of golf to a neophyte player, the method of teaching has become essentially stereotyped. The method is stereotyped in the sense that the student intending to learn the game of golf is instructed in the techniques of gripping and swinging the clubs, learning the proper body position relative to the ball, swinging club so as to groove the swing, and hitting the golf ball in the various shots required in the game. The student does this utilizing the same set of clubs and balls as are sued by experienced players.

This means that in addition to learning the mechanics of the game the player also has to overcome the psychological handicap of the fact that the regulation, conventional golf ball is of a relatively small size and therefore difficult to strike for the unskilled beginner. The small size of the golf ball, coupled with the relatively small size of the clubheads used to strike the ball, have a tendency to impose a very unnecessary psychological handicap on the learning process. This handicap is the mental impression that there is an extremely small margin of error which is allowable in making a satisfactory and acceptable golf shot or in even getting the ball airborne.

To be specific, the regulation golf ball in use under U.S. Golf Association rules is 1.68 inches in diameter. A second golf ball which is now being phased out somewhat is the so-called "British ball" which is even smaller than the U.S. ball, this ball being 1.62 inches in diameter. In both cases, the weight of the ball is 1.62 ounces and regulations governing the construction of the ball impose strict limitations on the velocity of the ball at impact when struck by a measured amount of force. This limitation is a velocity of 250 ft/sec with a tolerance of 2%.

The conventional teaching method for instructing a player in the techniques of playing golf uses the conventional U.S. or British golf ball and the conventional clubs as the starting point. Once the fundamentals of grip, body position and swing were known and partly mastered, the student was then introduced to the actual experience of hitting a golf ball. In its basic form the student was taken to a practice tee where he was presented with a supply of golf balls of conventional size and weight and golf clubs of conventional size and weight and the process of learning to strike the golf ball and hit it in the desired direction was undertaken.

For most individuals the process of learning the game of golf was essentially a matter of practice with increasing amount of skill coming with a great deal of practice. Truly dedicated student of the game became more comfortable and more accomplished at the game more rapidly due to the amount of time devoted to practice and due in part to a certain physical aptitude for learning the game.

For a large number of students, however, the instruction as to the mechanics of the game and the fundamentals were clouded and in a sense threatened by the problem of a mental adjustment and acceptance of the size of the playing tools of the game. In addition to assimilating the mechanical techniques, it was necessary also to adjust to and accept the mechanical sizes of the game. For the vast majority of players, the process of learning the game of golf was unnecessarily extended due to the necessity to overcome these two significant mental hazards. In literally thousands of cases, the student gave up and abandoned the effort of learning how to play golf.

SUMMARY OF THE INVENTION

The present invention provides a method for teaching golf wherein the student learning the game of golf is introduced to the game starting with a first ball which is significantly larger than the conventional golf ball. The method contemplates teaching the student the fundamentals of the game utilizing the oversize ball and continuing the instruction of the student with this ball until the fundamentals and technique of the game have been somewhat assimilated. After a period of time (and it will vary somewhat from person to person), the method then takes the student to one or more golf balls which are intermediate in size between the size of the starting ball and the size of the conventional regulation ball and continues the instruction until the student has satisfactorily improved the mechanics of his game utilizing this intermediate size ball. The method completes the teaching of the basics and fundamentals of the game by introducing the student to the use of a conventional size golf ball. Teaching golf by the method of the present invention eliminates 50% to 75% of the time normally required to learn. In the usual situation, a progression from a large ball to one or two of intermediate size to the conventional ball has been found to provide a sufficiently gradual approach to the teaching of the game of golf to eliminate the problems posed by starting with the small regulation size immediately.

The method according to the present invention also contemplates the use of golf clubs specially tailored to this golf method. (Such clubs would have enlarged clubeheads, the increase in size corresponding to the size increase of the starting ball utilized in the present method.) A partial set of such oversize clubs such as one or two woods and a 3, 5, 7, 9 and wedge set of irons is presently contemplated as being sufficient.

The invention also contemplates apparatus for use in the teaching of the game of golf which comprises a set of golf balls. Each ball in the set is of a different predetermined size and weight and the set comprises at least 3 golf balls; the first ball having a diameter of 1.80 inches, the second ball having a diameter of 1.74 inches and the third ball having a diameter of 1.68 inches.

The advantages of the method of teaching the game of golf according to the present invention is that it is possible to introduce a student to the game and teach it in fifty to seventy-five percent less time than has heretofore been required. The reduction in the time required to learn the game of golf is accomplished by eliminating more than half of the problems encountered in learning the game. The problems eliminated are those of adjusting to the sizes of the conventional equipment. The student learning the game of golf with a golf ball of a size such as 1.8 inches in diameter using an oversize golf club head is confronting a size that does not produce the psychological problems that a smaller ball does. Thus, in learning the mechanics of the game the student is enabled to ignore the problems of being able to strike a small ball with a small club, since both are of a size now to relieve that consideration from his mind and allow him to approach the learning of the game in a much more relaxed frame of mind.

Other advantages of the present invention include an alternative to conventional golf for handicapped persons and for older persons whose physical abilities may now be limited. By providing a set of equipment including clubs and balls which are larger in size than the regulation size, years of added playing time are generated particularly for senior citizens, who suffer from such infirmities of old age as arthritis or bursitis, muscular restriction, back problems, or general physical impairments. It likewise opens the game up to students, office workers, and the like, who otherwise would not have the time or the incentive to try to master the game.

The use of oversize golf balls also has an inherent effect in improving any golfer's game in that the larger ball will in normal circumstances always find itself in a much better lie on the golf course after having been struck. Due to the fact that the ball is larger, it is less likely to find its way into small depressions on the course, is less likely to burrow its way into the sand and the bunkers, and in general sits up better no matter where the ball lies on the course.

Another extremely important advantage is that play with the larger ball is much faster. The ball is easier to follow and easier to find. Elimination of lost ball problems and reduction in the number of shots to be taken speeds the elapsed time of the average round and thereby permits more players on the course per unit time. This can be a significant factor in helping course operators to hold the line on greens fees and other expenses of the course.

DESCRIPTION OF THE DRAWINGS

These and other advantages of the present invention will be better understood by reference to the following figure, wherein.

DETAILED DESCRIPTION OF THE INVENTION

Figures 1A, 1B, 1C, 1D, 1E:
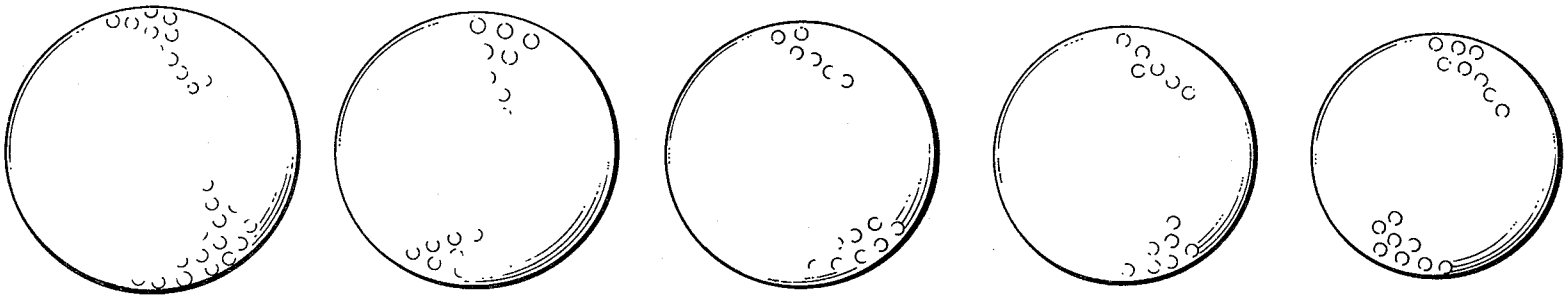
FIG. 1A is an elevational view of an oversize golf ball used as the starting point in the method of teaching according to the present invention.
FIG. 1B is an elevational view of an intermediate size golf ball according to the present invention.
FIG. 1C is an elevational view of still another intermediate size golf ball according to the present invention.
FIG. 1D is an elevational view of still another intermediate size golf ball according to the present invention.
FIG. 1E is an elevational view of a conventional regulation size golf ball.

As shown in FIB. 1 the method of teaching golf according to the present invention starts with a ball which is 1.92 inches in diameter (FIG. 1A). It is contemplated that the weight of the ball will also be increased to approximately 1.9 or possibly 2 ounces. The heavier ball has the advantage of reducing the amount of "hook" or "slice" encountered during the learning period.

When a teacher is introducing a student to the game after explaining the mechanics of the game, including the grip, the stance, and the swing, the first introduction to actually utilizing a golf club and golf ball is done using the 1.92 inch or possibly a 1.86 inch (FIG. 1B) diameter ball, depending on the instructor's judgment. As the student progresses and begins to master the game, he moves to an incrementally smaller ball such as those shown in FIGS. 1C and 1D. The ball of FIG. 1C is 1.80 inches in diameter and weighs approximately 1.8 ounces. The ball of FIG. 1D is 1.74 inches in diameter and weighs approximately 1.74 ounces. In the final transition after satisfactory proficiency with the larger equipment is achieved, the student moves to utilization of regulation equipment conforming in all respects to USGA and PGA requirement.

The second aspect of the teaching method according to the present invention is the provision of oversize clubs corresponding to the oversize ball used initially to start the beginner. A selection of woods and irons with heads and club faces which are larger than conventional clubs and enlarged in proportion to the enlargement of the ball are used. Clubs having a configuration such as those which are the subject of U.S. Pat. No. 3,947,041 are particularly suitable for use with the method of the present invention. Thus, in the presently preferred embodiment, the enlargement of the hitting face would be in the proportion of, for example, 1.86/1.68, the ratio of the diameter of the largest golf ball according to the present invention to a conventional ball. The irons are similarly enlarged so that the student has a feeling of confidence and a subconscious feeling of an ability to hit the large ball with the large hitting surface. By eliminating this concern from the mind of the student, concentration can be given to the learning of the fundamental aspects of the game while at the same time having a more relaxed and natural approach to the game. A selection of oversize clubs is sufficient to introduce the student to the game. Contemplated are 1 and 3 or 4 or 5 woods, 3,5,7,9 and wedge irons. The size of the putter and cup remains the same. In all other aspects except the size of the clubhead, the equipment to be utilized with the present method is contemplated to be conventional regulation shafts and grips. In the preferred embodiment of the invention the weight of the club, even in the most enlarged version, will be maintained as close as possible to the weight of a regulation club. In this way the other aspects of learning the game of golf, such as position of the body relative to the ball, the bend from the waist, the stance, the correct bending of the right and left knee, the position of the weight on the feet, and the position of the player's head relative to the location of the ball would be the same as in the presently accepted procedures for the teaching of golf.

The teaching then progresses through the swing itself. Because the student is almost unconcerned about his ability to make contact with the larger ball, the mechanics of the swing can be concentrated on without concern or fear of inability to hit the ball, enhancing a far greater degree of confidence within himself or herself. A significant source of trouble in learning the game of golf is the subconscious adjustment of the swing due to the player's fear of his inability to hit the ball. By virtually eliminating this concern, the player can be interrupted in the proper way to start the club away from the ball, the use of the hands, the cocking of the wrists, the position of the club in the backswing, the extent of the backswing, and the maintenance of the proper body position without subconscious fears causing a departure from the accepted form. Likewise, the downswing can be followed consistently with the way the instructor shows the student, again because a source of distraction and a source of loss of concentration has been very considerably reduced.

Having instructed the player in the fundamentals of the game, the next step is for the player to put the abstract instructions which he has received into practice. This is normally accomplished on a practice tee, and according to the present invention the student utilizes the larger set of clubs and the largest ball and continues to hit with these clubs and this ball until a degree of proficiency has been achieved which is satisfactory to the instructor and a degree of confidence has been achieved satisfactory to the player. Depending upon athletic ability, individuals will vary somewhat in the amount of time required to develop this level of proficiency and confidence and the present invention contemplates that the player will continue to use the same size ball and clubs until sufficient proficiency and confidence is achieved. This should be no more than 25% to 50% of the time now required. Once it has been achieved, the student moves on to the next stage or progression, the intermediate size balls. As presently contemplated, the progression is from a ball 1.86 inches in diameter to balls 1.80 and 1.74 inches in diameter. Again, the object is to practice using balls of this size until a certain level of skill, proficiency and confidence has been achieved and the beginner now feels he can go on the golf course and start to play. At this point the next transition in the presently preferred embodiment of the invention is to move to conventional size clubs and conventional balls and the player will then continue to practice to maximize his skills.

It is contemplated that throughout the learning process the student not only will utilize the clubs and balls on the practice tee but will also be allowed to play under actual playing conditions utilizing the oversize balls and oversize clubs. In this way the student can further see and concentrate on mastering the mechanical aspects of the game without the mental hazard of worrying about his ability to make contact between club and ball. Formerly, when playing under actual playing conditions, the learning student became inordinately preoccupied with the thought while addressing the ball and in the actual swing that he might hit the ball poorly or completely miss the ball. Such a concern is considerably and significantly diminished, if not eliminated, since the student has the innate confidence born of seeing what appears to be a significantly larger ball and knowing that the hitting surface of the clubhead is likewise significantly larger. The progression from large size to intermediate size to small size continues both on the course and on the practice tee and the ultimate achievement of level of ability will thereafter depend upon the individual's skill, athletic ability and general aptitude for the game of golf.

In addition to its primary application as a teaching method, the present invention is also applicable as an alternative form of the playing of the game of golf. By utilizing one of the larger-than-regulation size balls and sets of clubs, the enhancement of the enjoyment of the game of golf can be immeasurable for thousands or millions of new players. Thus, the present invention also contemplates a non-regulation golf game in which the participants engage strictly for the purpose of enjoyment and pleasure. For instance, it could be possible for a player using oversize balls and clubs with a handicap established with such equipment to compete against a fellow player using conventional equipment and playing to his normal handicap developed using conventional equipment.

The applications are numerous and include the possibility of a family foursome of golf wherein the father may play with regulation balls and clubs, the wife may play with an intermediate size, and the children may play with the largest size. All are able to play the game with a reasonable degree of proficiency without the commensurate problems of frustrations which can result from a lack of sufficient familiarity or a lack of sufficient skill to enjoy the regulation game of golf, and without unnecessarily holding up the play on the golf course. Likewise, any one of the players can change to more challenging equipment when ready.

In playing golf in this manner, it is contemplated that the oversize clubs and balls would be used from tee through fairway to approach shots to the green, with the possibility of, but not necessarily, substituting a regulation ball (1.68 in.) on the green for putting purposes. The game of golf can likewise be made more enjoyable for the multitude of handicapped persons and the ever-increasing number of older players whose mobility and flexibility may be impeded by passing time. Again, the benefits of playing the game of golf, the ability to be out of doors in a pleasant setting with the commensurate benefits of exercise, mental stimulation and relaxation can be achieved while still being able to play the game of golf with a greater degree of proficiency.

In all aspects, the development of a larger, more easily playable ball reduces, for all, the tedious problem of trying to hit a ball that is too small for most people to learn and to play with.

What is claimed is:

1. Apparatus for use in the teaching of the game of golf comprising a set of golf balls of predetermined size and weight, said set comprising at least three golf balls, said first ball having a diameter of 1.80 inches, said second ball having a diameter of 1.74 inches, and said third ball having a diameter of 1.68 inches.

2. Apparatus according to claim 1 wherein the weight of said 1.80-inch ball is 1.8 ounces, the weight of said 1.74-inch ball is 1.74 ounces.

3. Apparatus according to claim 1 wherein the set of golf balls includes at least four golf balls, the fourth ball in the set having a diameter of 1.86 inches.

4. Apparatus according to claim 3 wherein the weight of said fourth ball is 1.86 ounces.

5. Apparatus according to claim 1 wherein the set of golf balls includes at least five golf balls, the fifth ball in the set having a diameter of 1.92 inches.

6. Apparatus according to claim 5 wherein the weight of said 1.92-inch ball is 1.92 ounces.

* * * * *